US008984926B2

(12) United States Patent
Davidsen

(10) Patent No.: US 8,984,926 B2
(45) Date of Patent: Mar. 24, 2015

(54) MACHINE FOR THE EXPANSION OF PIPES

(75) Inventor: Michael Davidsen, Nørresundby (DK)

(73) Assignee: Amida A/S, Lokken (DK)

( * ) Notice: Subject to any disclaimer, the term of this patent is extended or adjusted under 35 U.S.C. 154(b) by 814 days.

(21) Appl. No.: 13/138,704

(22) PCT Filed: Mar. 26, 2010

(86) PCT No.: PCT/DK2010/000037

§ 371 (c)(1),
(2), (4) Date: Sep. 20, 2011

(87) PCT Pub. No.: WO2010/115427

PCT Pub. Date: Oct. 14, 2014

(65) Prior Publication Data

US 2012/0011916 A1 Jan. 19, 2012

(30) Foreign Application Priority Data

Apr. 6, 2009 (DK) ..... 2009 00463

(51) Int. Cl.
*B21D 39/20* (2006.01)
*B21D 53/08* (2006.01)

(52) U.S. Cl.
CPC ..... *B21D 53/085* (2013.01); *B21D 39/20* (2013.01)
USPC ..... 72/449; 72/31.06; 72/209; 72/289; 72/423; 29/727

(58) Field of Classification Search
CPC ..... B21D 39/20
USPC ..... 72/31.06, 208, 209, 289, 393, 423, 449; 29/727; 405/168.3, 183.5, 184.3
See application file for complete search history.

(56) References Cited

U.S. PATENT DOCUMENTS 2,343,890 A * 3/1944 Dewald ..... 72/393
3,397,564 A * 8/1968 Schroeder ..... 72/113

(Continued)

FOREIGN PATENT DOCUMENTS

CN 2247067 2/1997
CN 1522810 8/2004

(Continued)

OTHER PUBLICATIONS

Chinese Office Action and English translation thereof dated Apr. 2, 2013.

(Continued)

*Primary Examiner* — Edward Tolan
(74) *Attorney, Agent, or Firm* — Harness, Dickey & Pierce, P.L.C.

(57) ABSTRACT

A machine is disclosed for the expansion of pipes for heat exchangers, including a machine frame equipped with a drive unit for pressing or pulling an expansion mandrel through a pipe as well as an expansion mandrel. In at least one embodiment, the machine includes at least one drive unit with at least one motor-driven drum as well as a band or wire guide which extends horizontally from an outlet of the drum and forwardly to the pipe, the drive unit including a set of lateral plates. In at least one embodiment, the drum is disposed between the lateral plates of the drive unit and is equipped with a band or a wire and is additionally adapted to press or pull a band or a wire with an expansion mandrel through a pipe, wherein the expansion mandrel is expandable. In at least one embodiment, the drum includes two lateral plates, a hub and a circular guideway, the hub including a driving gearwheel and at least two idling gearwheels arranged internally in and in engagement with a toothed rim in the hub, and wherein the circular guideway of the drum is formed by bearings disposed in a circle between the sides of the drum and along the outermost rim of the sides.

11 Claims, 9 Drawing Sheets

(56) References Cited

U.S. PATENT DOCUMENTS

Figure 1:
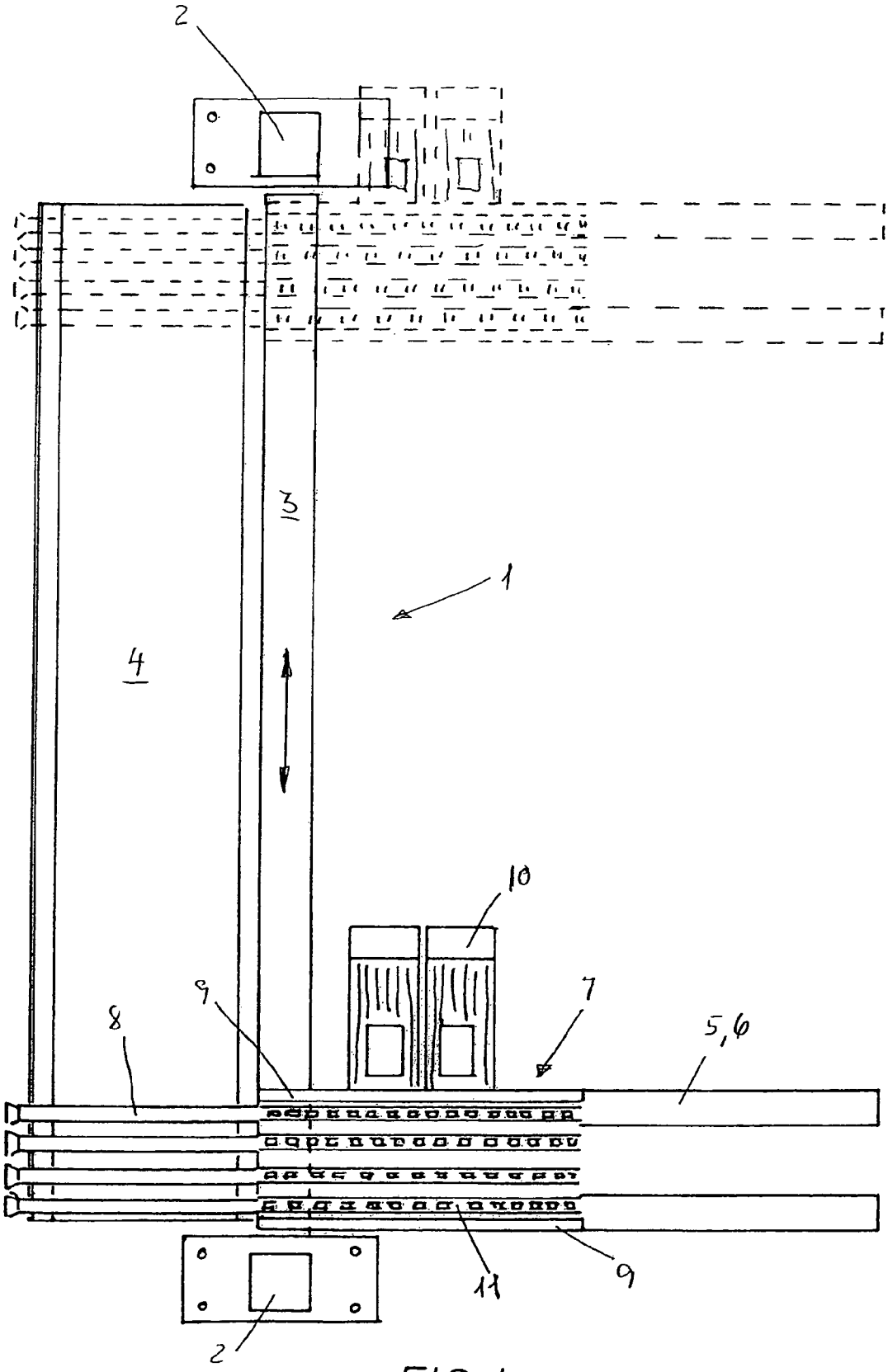

| | | | | |
|---|---|---|---|---|
| 4,595,173 | A * | 6/1986 | Anderson | 254/342 |
| 5,685,190 | A | 11/1997 | Yamamoto et al. | |
| 5,916,321 | A | 6/1999 | Holmes et al. | |
| 7,422,424 | B2 * | 9/2008 | Kark | 425/224 |
| 2004/0211056 | A1 | 10/2004 | Nakadeguchi et al. | |

FOREIGN PATENT DOCUMENTS

| | | | |
|---|---|---|---|
| CN | 101045249 | | 10/2007 |
| JP | S52-055941 | | 5/1977 |
| JP | 53109861 | A | 9/1978 |
| JP | 54136564 | A | 10/1979 |
| JP | 59010427 | A | 1/1984 |
| JP | H04-319030 | A | 11/1992 |
| JP | H07-021229 | | 1/1995 |
| JP | H07-068331 | | 3/1995 |
| JP | S52-055941 | | 5/1997 |
| JP | 2000301271 | A | 10/2000 |
| JP | 2001105060 | A | 4/2001 |
| JP | 2005000928 | A | 1/2005 |

OTHER PUBLICATIONS

Notice of Rejection for corresponding Japanese patent application No. 2012-502455 issued on Mar. 11, 2014.

* cited by examiner

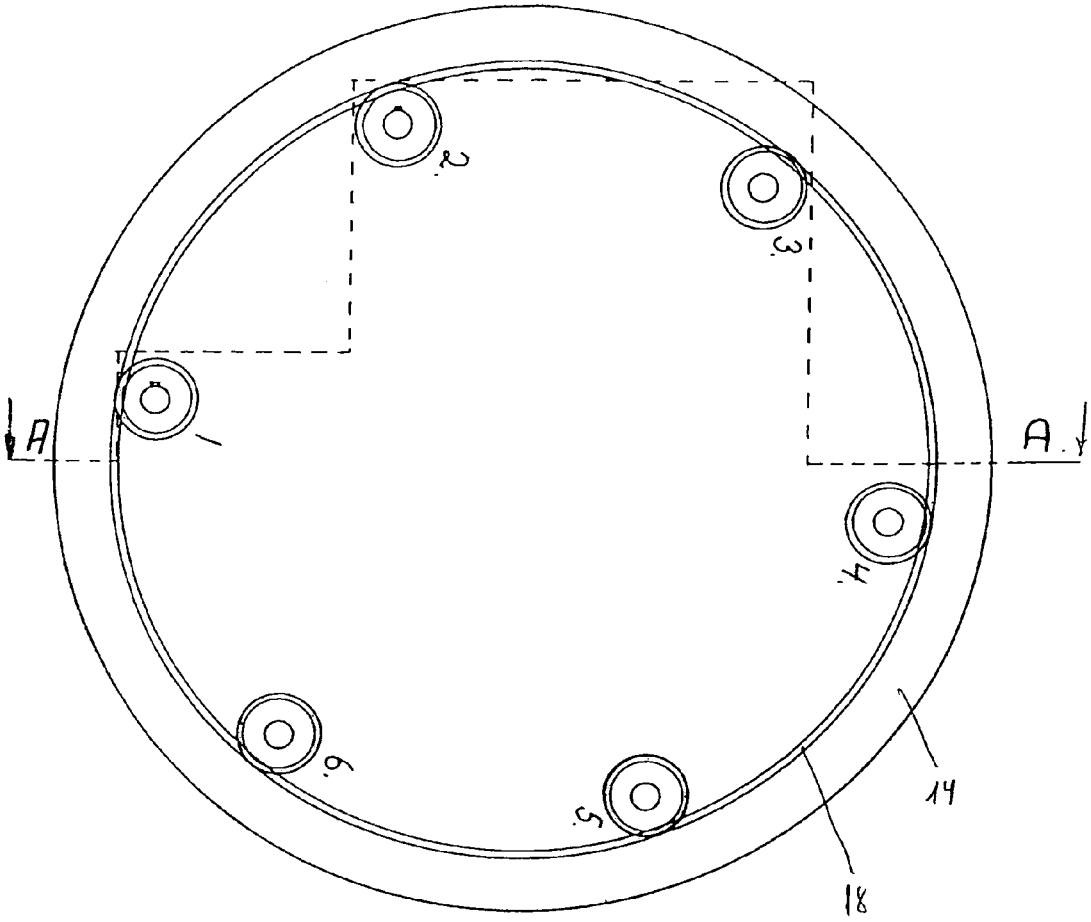
FIG. 5.1
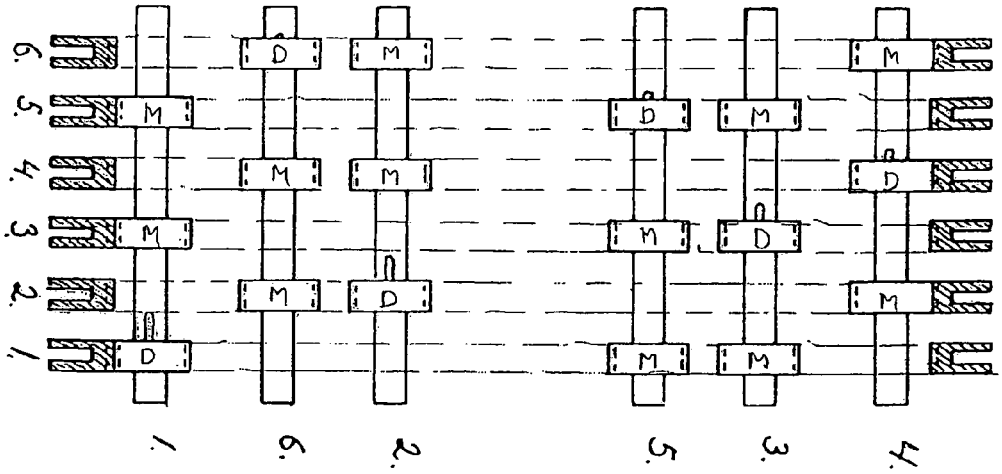
A - A FIG. 5.2

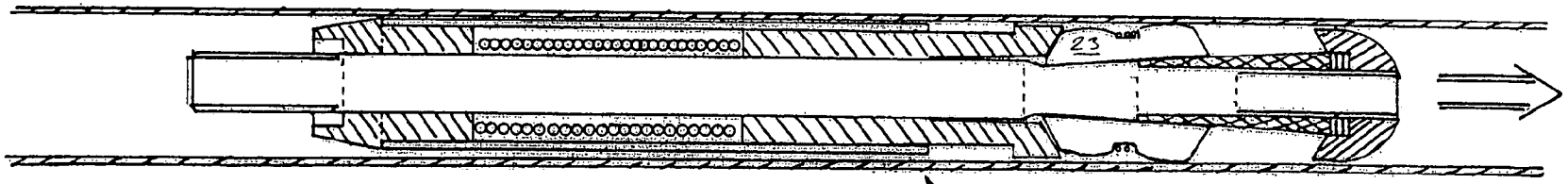
FIG. 6.1
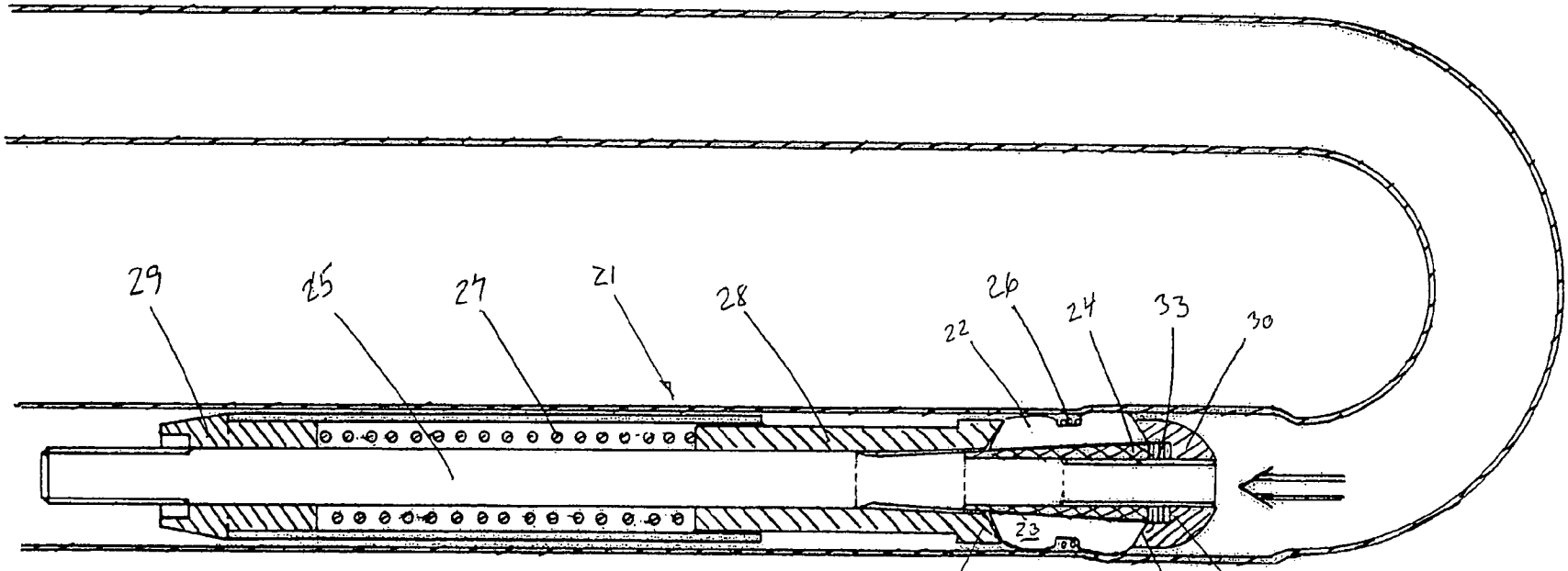
FIG. 6.2

MACHINE FOR THE EXPANSION OF PIPES

The present invention relates to a machine for the expansion of pipes, in particular for the expansion of pipes for heat exchangers, comprising a machine frame equipped with a drive unit for pressing or pulling an expansion mandrel through a pipe as well as an expansion mandrel, said machine (1) comprising at least one drive unit (7) having at least one motor-driven drum (11) as well as a band or wire guide (8) which extends horizontally from the outlet of the drum and forwardly to the pipe, said drum being disposed between the lateral plates (9) of the drive unit and being equipped with a band or a wire and being additionally adapted to press or pull a band or a wire with an expansion mandrel through a pipe.

THE PRIOR ART

JP 2000301271 (A) discloses a machine system for the expansion of pipes for heat exchangers. The machine expands the pipes in the heat exchanger by pressing an expansion mandrel through the pipe.

JP 59010427 (A) also discloses an expansion system for the expansion of pipes in heat exchangers. It is also shown there that the pipes are configured with a hairpin shape, and that the expansion mandrel is pressed into the pipes at the open end.

One of the drawbacks of pressing an expansion mandrel through the pipe is that the pipe, while having its diameter increased, shrinks lengthwise, which means that the positions of the hairpins at the end of the heat exchanger will be different. This is caused by the fact that the dimensions of the pipes, including the thickness, are not completely the same.

Another of the drawbacks is that relatively great forces have to be applied for the expansion of the pipes when the expansion mandrel is advanced by a pressure rod, in particular if, for reasons of production, it is desired to expand a large number of pipes at the same time.

The document JP 2001105060 A describes a machine for the expansion of pipes. The machine has an expansion mandrel which is pulled through the pipe. The machine is provided with a drive unit having a drum with a wire which is secured to the expansion mandrel. Since the expansion drum is non-expandable, the wire must be passed through the pipe, before it is coupled to the mandrel, and before the firm mandrel may be pulled through the pipe. The machine is not suitable for expanding a large number of pipes at the same time.

THE OBJECT OF THE INVENTION

It is the object of the invention to provide a machine of the type mentioned in the opening paragraph, which remedies the drawbacks mentioned above.

It is a further object of the invention to provide solutions which ensure that the machine may be built so as to be compact and to have a great capacity.

SUMMARY OF THE INVENTION

The above-mentioned object is achieved by a machine for the expansion of pipes for heat exchangers, the machine being constructed so as to comprise at least one drive unit which comprises a set of lateral plates between which at least one motor-driven drum is disposed, said drum being equipped with a band or a wire and being additionally adapted to press or pull the band or the wire equipped with an expandable expansion mandrel through a pipe, as well as a band or wire guide which extends horizontally from the outlet of the drum and forwardly to the pipe.

With this drive unit, it is possible to expand a pipe by first introducing an unexpanded mandrel into the pipe until the starting point of the expansion and then expanding the mandrel and thereby the pipe by a pull.

The mandrel is introduced into the pipe with a band or a wire, which is unwound from the motor-driven drum. At the introduction, the diameter of the mandrel has been reduced so that the diameter is smaller than the internal diameter of the pipe. The introduction opening of the pipe engages a band or wire guide, which forms a stop for the pipe when the mandrel is pulled back. The mandrel is pulled back by reversing the direction of rotation of the drum in the drive unit. The pull causes the mandrel to open such that the mandrel expands the pipe. It has been found that less work is required for the expansion by a pull than by a pressure.

By expanding the pipe by a pull it is ensured that the shrinkage of the length of the pipe which is produced by the expansion of the pipe, takes place at the open pipe end. Then, it is no problem to cut the pipe ends to the same length or to apply a counterpressure to the pipe ends so that they shrink uniformly.

The drive unit may be equipped with more drums and drum guides, thereby making it possible to expand more pipes in one operation.

The expansion mandrel is expandable, and the motor-driven drum is constructed such that it comprises two lateral plates, a hub and a circular guideway, said hub comprising a driving gearwheel and at least two idling gearwheels arranged internally in and in engagement with a toothed rim in the hub, said circular guideway of the drum being formed by a plurality of bearings disposed in a circle between the sides of the drum and along the outermost rim of the sides.

Hereby, it is possible to unwind a band or a wire from the drum for the introduction of the expansion mandrel into the pipe, and subsequently to pull the mandrel back by winding-up the band or the wire. In this connection, the circular guideway of the drum is the means that allows a band or a wire to be unwound and be introduced into the pipe, as the bearings of the guideway support the band or the wire en route.

When the drive unit is equipped with a plurality of drums disposed side by side between the lateral plates of the drive unit, and each drum is connected with a separate motor drive and a band or wire guide of its own, it is ensured that the capacity of the machine is increased, as more pipes may be expanded in one operation.

When each motor drives a shaft which extends between the lateral plates of the drive unit and is mounted therein, and which is in firm engagement with a driving gearwheel to a first drum and in loose engagement with a plurality of idling gearwheels to other drums, it is ensured that a large number of drums may be assembled in the same drive unit.

Further it is expedient to construct the drive unit such that the distance between the drums may be adjusted. It is ensured hereby that the machine may be adjusted to expand pipes of different diameters and thereby heat exchangers having different geometries and capacities.

When the machine is equipped with two or more drive units disposed either side by side in a mirror-inverted version and in an upright position or as pairs in a mirror-inverted version with the first pair in an upright position and the second pair in a reversed position and additional pairs arranged correspondingly in a retracted position, a great increase in the capacity of the machine is achieved in a relatively limited space.

When the expansion mandrel is constructed such that it comprises an expansion ball consisting of at least three shell parts which surround a centre cone, said cone being mounted on a centre member, and the shell parts are configured such that they are additionally surrounded by a spring which keeps the shell parts in position, a tool is achieved which is suitable for the expansion of pipes.

This tool is capable of being introduced into the pipe in the state where the diameter is minimal. This state is achieved when the mandrel is introduced into the pipe, as the friction against the pipe wall pushes the shell parts back toward the narrow part of the cone. When the mandrel is pulled out, the thick part of the cone is moved further inwards between the shell parts, so that the mandrel is expanded and the pipe is expanded.

When the expansion mandrel is equipped with a counter-pressure spring, a cylinder member with a bearing bush, a stop bushing, fitting discs and an end nut, a functional and adjustable tool is achieved.

Further it is expedient to configure the end nut with a rounded side and with an oppositely directed engagement face, said engagement face being configured as a bearing bush adapted to the shape of the shell parts, and with a recess to receive one or more fitting discs.

The rounded shape of the end nut ensures that no obstacles occur when the mandrel is introduced into the pipe. The shape of the engagement face of the nut determines how much the mandrel may expand. The extent of the expansion may be adjusted by positioning one or more fitting discs in the shown recess.

THE DRAWING

Figure 1A:
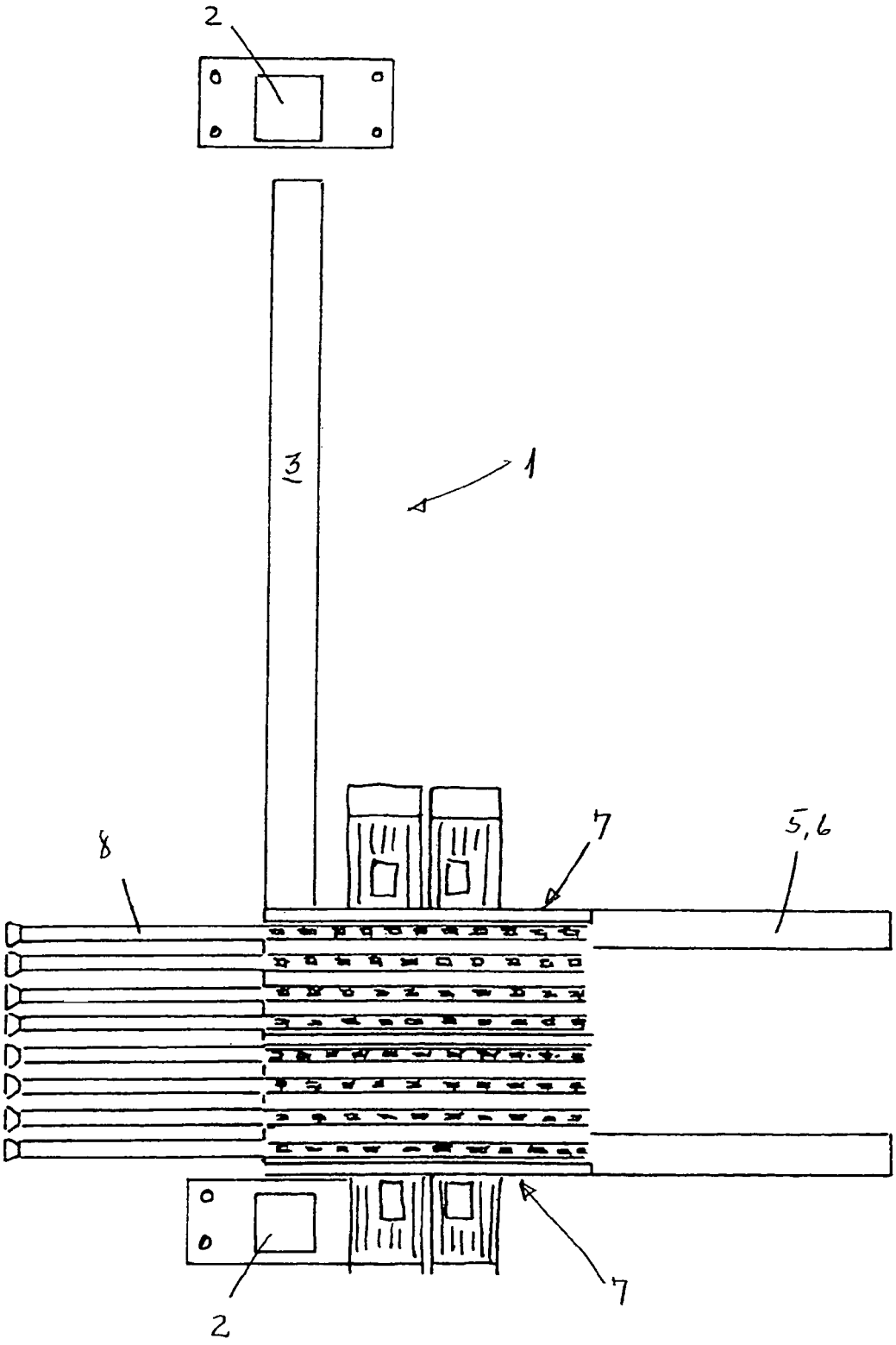
Figure 1B:
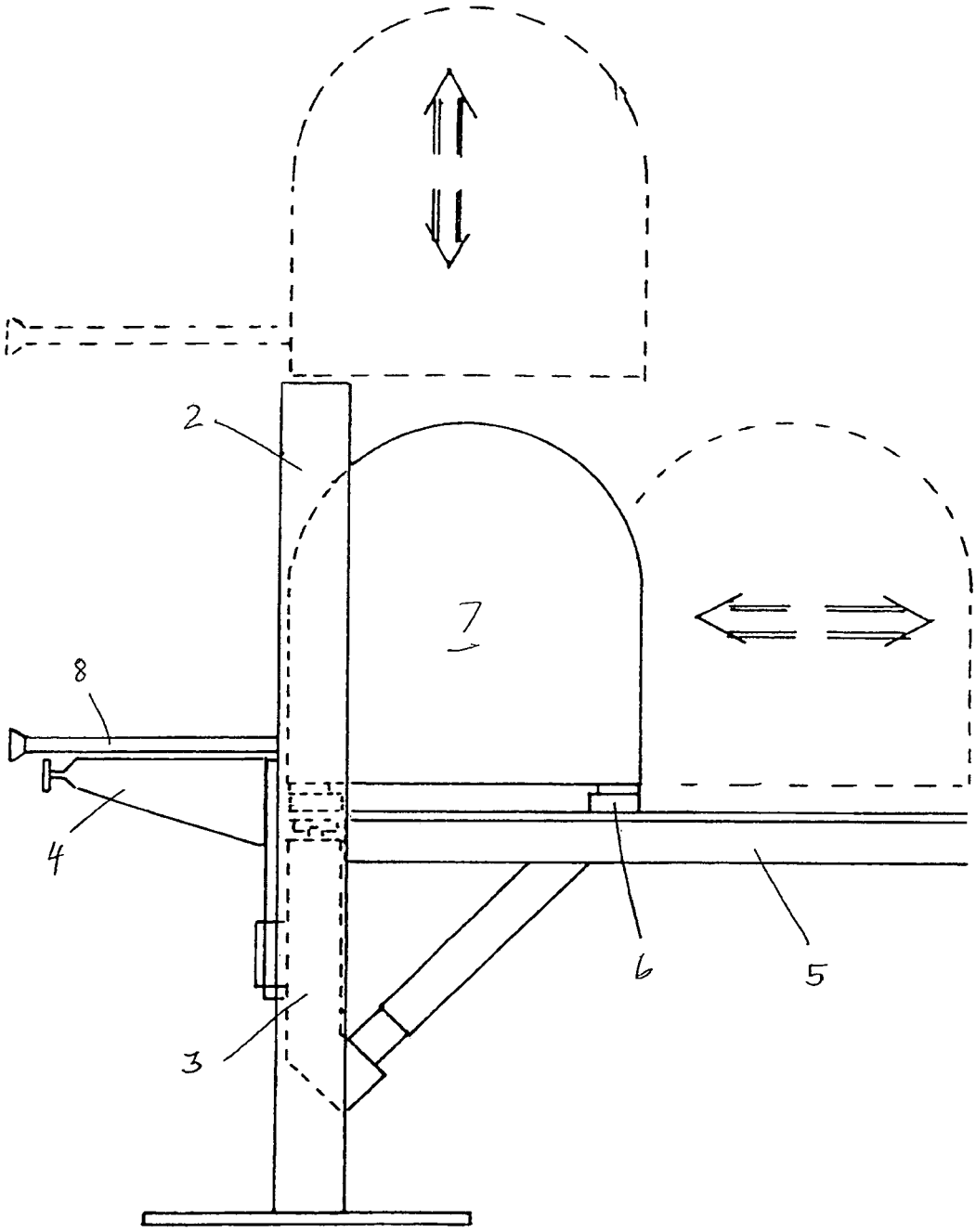
Figure 2:
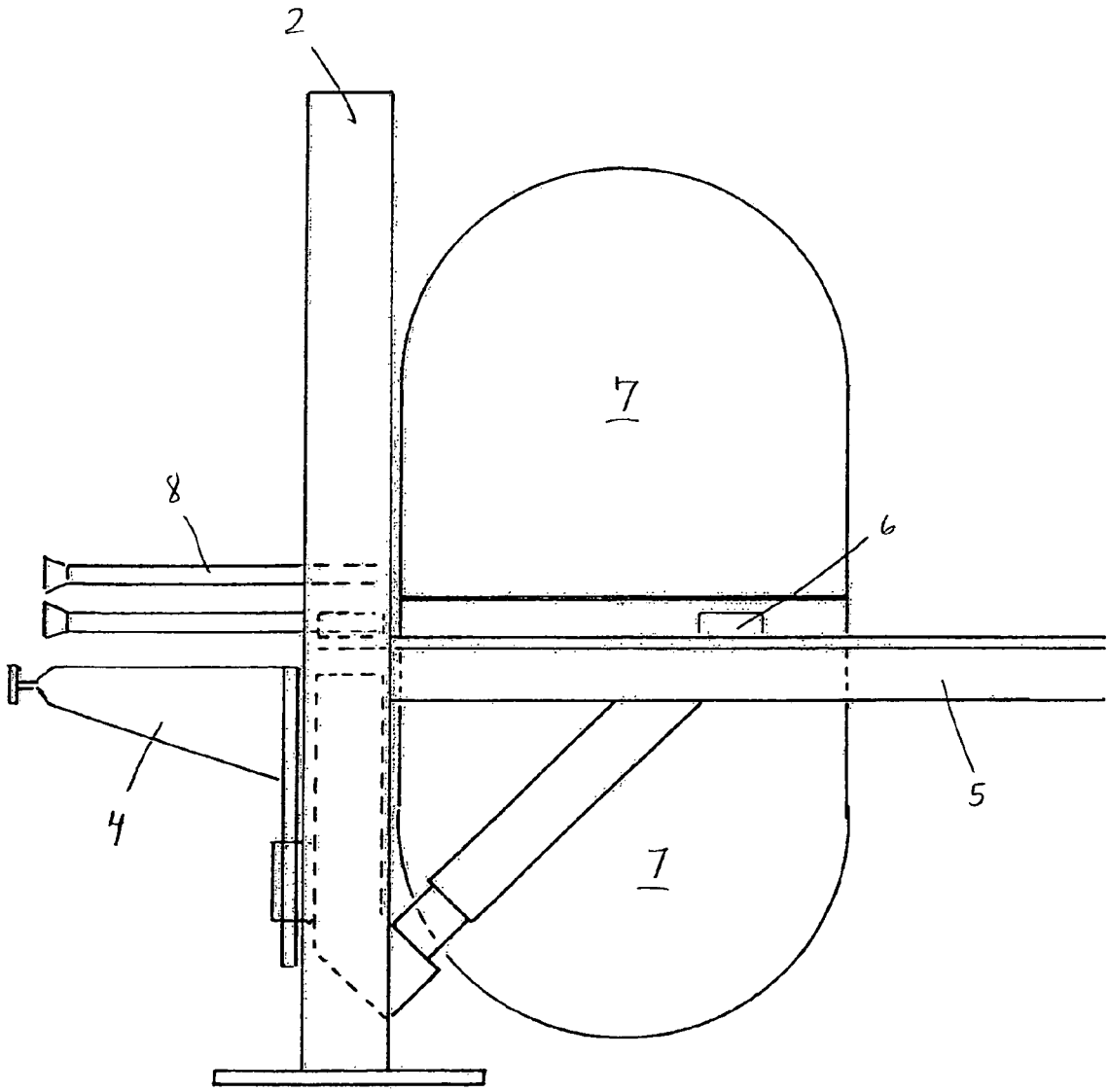
Figure 2A:
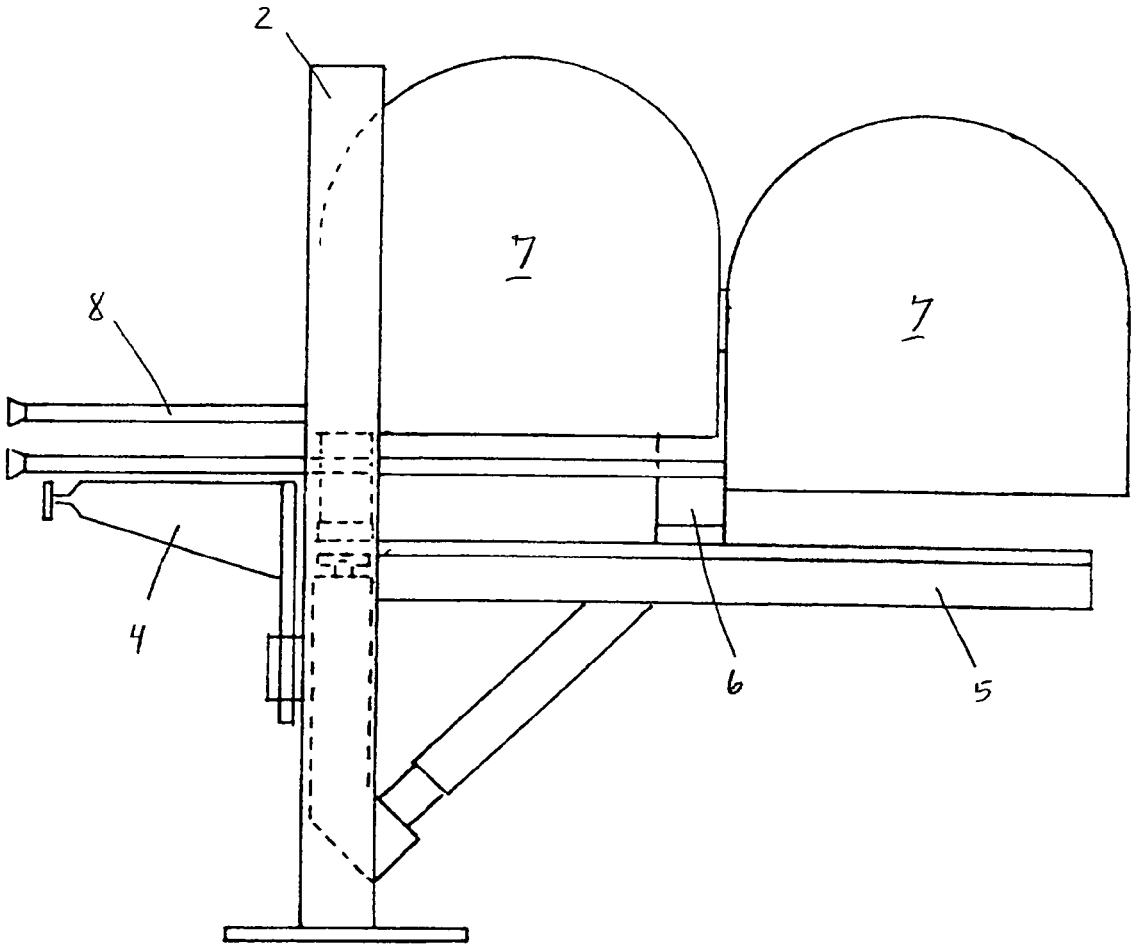
Figure 3:
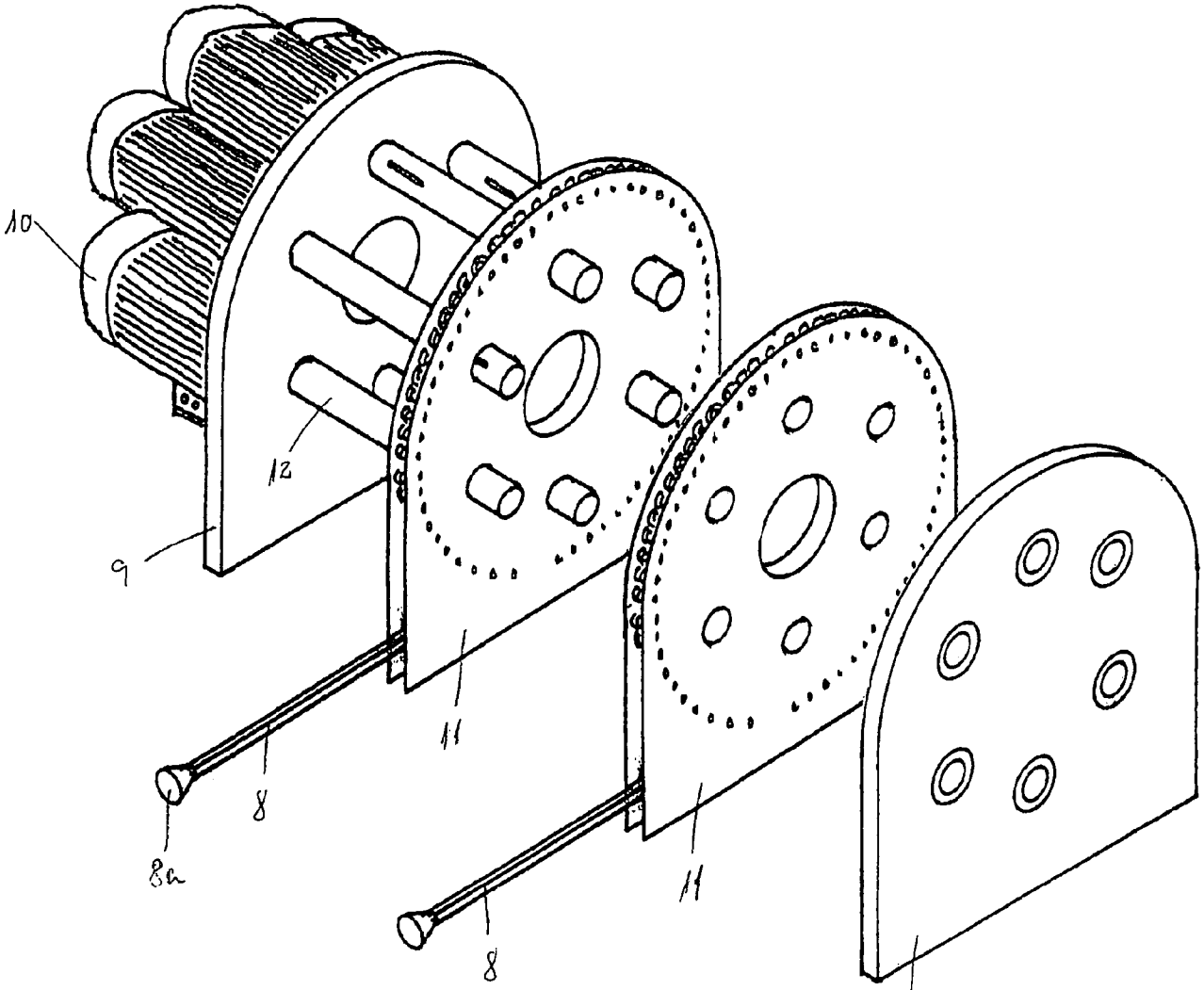
Figure 4:
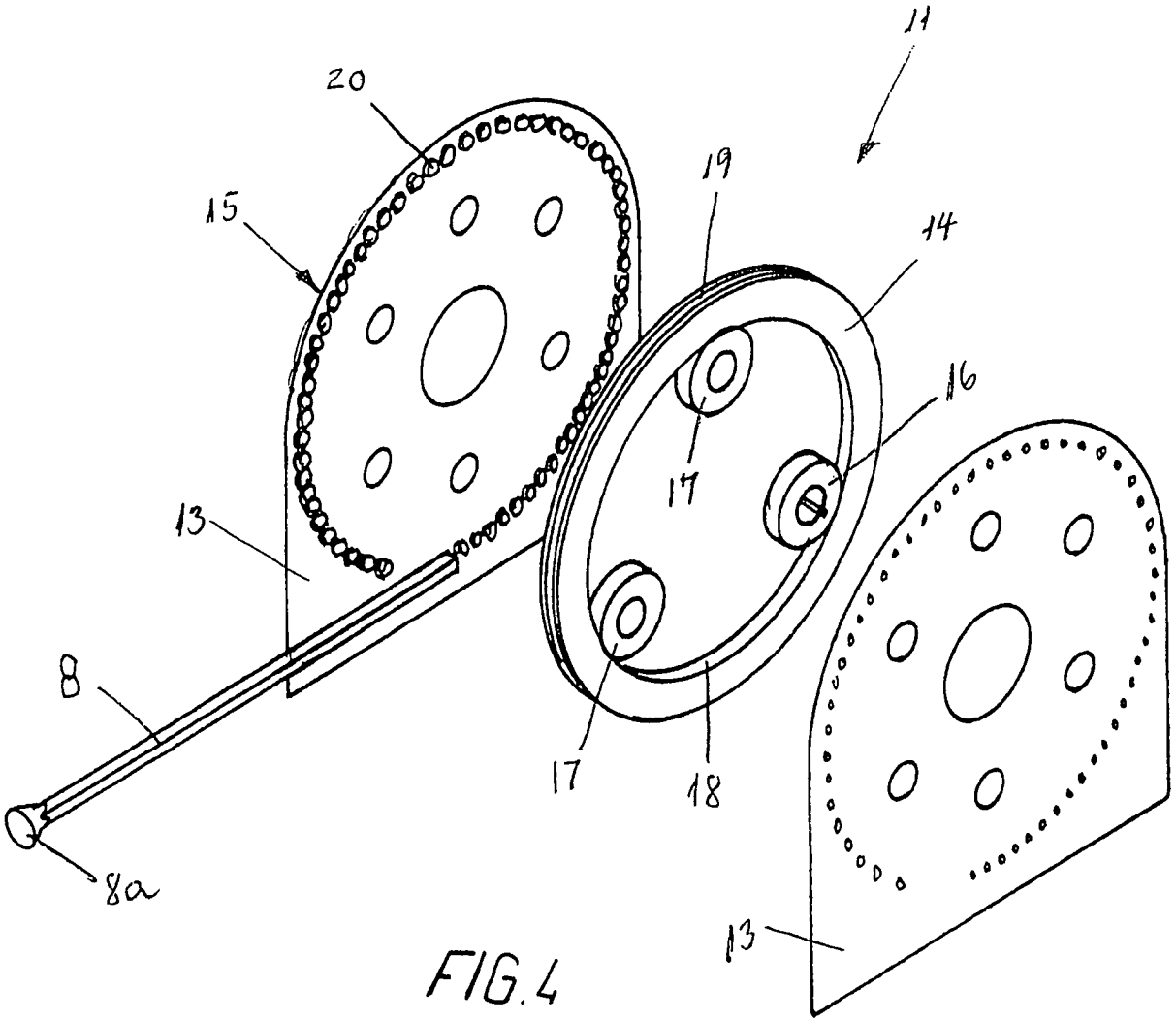

Exemplary embodiments of the invention will be explained more fully below with reference to the drawing, in which:

FIG. 1 shows the basic structure of the machine according to the invention, seen from above, FIG. 1*a* shows the machine equipped with a non-inverted and a mirror-inverted drive unit, seen from above, FIG. 1*b* shows how a drive unit may be displaced on the machine frame, seen from the side, FIG. 2 shows the machine, seen from the side, equipped with a drive unit in an upright and a mirror-inverted position, FIG. 2*a* shows the machine, seen from the side, equipped with a drive unit arranged behind another drive unit, FIG. 3 shows the basic structure of a drive unit, FIG. 4 shows the structure of a drum, FIG. 5.1 shows the shaft positions in a drum stack having six drums, FIG. 5.2 shows a sectional view of positions of the driving gearwheels and the idling gearwheels in a stack of drums, FIG. 6.1 shows a cut expansion mandrel when being introduced into a pipe, and FIG. 6.2 shows a cut expansion mandrel when being pulled out.

DETAILED DESCRIPTION OF THE INVENTION

A machine according to the invention for the expansion of pipes, in particular for the expansion of pipes for heat exchangers is shown in FIGS. 1-6.

FIG. 1 shows the machine 1 for the expansion of pipes, seen from above. The machine frame consists of two uprights 2, between which a vertically oriented bridge 3 and a horizontally oriented bridge 4 are disposed. The bridges are adjustable in the height. A carriage 5, which may be moved between the two uprights, is mounted on the bridge 3. The carriage 5 has arranged thereon an additional carriage 6, which may be moved inwardly toward and away from the bridge 3. A drive unit 7 having a plurality of band or wire guides 8 is mounted on the carriage 6. The drive unit is shown with the lateral plates 9, the drums 11 and the drum motors 10. Adjustment of the positions of the carriages 5, 6 and of the bridges 3, 4 may be carried out manually or by a motor drive.

FIG. 1*a* shows the machine, seen from above, equipped with a non-inverted and a mirror-inverted version of the drive unit 7, each equipped with four drums. This makes it possible to increase the capacity when the capacity of the individual drive unit is utilized fully.

FIG. 1*b* shows the machine seen from the side. A drive unit 7 is mounted on the carriage 6, which, in turn, is mounted on the carriage 5. The figure shows moreover that the drive unit may be displaced horizontally with the carriage 6, which may be reciprocated on the carriage 5. The drive unit may also be displaced vertically, as the bridge 3 with the carriages 5 and 6 may be adjusted in the height.

FIGS. 1*a*, 2 and 2*a* show the machine equipped with more drive units 7 arranged in various combinations. The drive units are arranged partly side by side, partly behind each other in an upright position on the carriage 6, partly in a reversed position below the carriage 6. All combinations may be established on the same machine at the same time. Hereby, more rows of pipes in up to four levels may be pulled at the same time, which is advantageous in the expansion of e.g. the pipes in a heat exchanger.

FIG. 3 shows the structure of a drive unit 7. The drive unit consists of a set of lateral plates 9, between which one or more drums 11 are arranged. The one lateral plate is configured such that one or more motors 10 with shafts 12 may be mounted. The other lateral plate is equipped with bearing bushings to support the shafts. The drums 11 are mounted on the shafts, said drums being shown with band or wire guides 8. The guides 8 are provided with a funnel-shaped opening 8*a*. The funnel ensures that the pipe ends on e.g. a heat exchanger may easily be caught. The funnel also serves as a stop in the pulling of the expansion mandrel.

The motors may be electrically or hydraulically driven and are reversible.

FIG. 4 shows the structure of a drum 11. The drum consists of two lateral plates 13, between which a hub 14 and a circular guideway 15 are arranged. The internal side of the hub is configured as a toothed rim 18, where a driving gearwheel 16 and two idling gearwheels 17 are in engagement with the toothed rim. On the outer side, the hub is provided with a groove 19 in which the band or the wire may be wound up.

The circular guideway 15 comprises a plurality of bearings 20 arranged in a circle round between the lateral plates with an opening for the band or wire guide 8. The low friction of the circular guide ensures that the band or the wire may be wound off the drum even though they are flexible.

FIGS. 5.1 and 5.2 show how the drive shafts in a drive unit with a stack of six drums are arranged. FIG. 5.1 shows the drum stack seen from the one end. A cutting line A-A is shown in the figure, and the sectional view is shown in FIG. 5.2.

FIG. 5.1 shows a hub 14 with an internally toothed rim 18, where the shafts 1-6 are arranged.

The sectional view of FIG. 5.2 shows the six drums 1-6 which are arranged on the shafts 1-6.

Each drum is associated with a driving gearwheel D and two idling gearwheels M, which, together, provide support for the drum. The driving gearwheels D are in firm engagement with their respective shafts by means of a tongue and groove arrangement.

When considering FIG. 5.2, it will be seen that the drum 1 has a driving gearwheel D on the shaft 1 and an idling gearwheel M on the shaft 5 and on the shaft 3. FIG. 5.1 shows that the shafts 1, 5 and 3 are positioned such that they constitute the apices of an isosceles triangle, and that, together, they support the drum 1.

FIG. 5.2 shows that the drum 2 has a driving gearwheel D on the shaft 2 and an idling gearwheel M on the shafts 6 and 4. FIG. 5.2 shows that the shafts 2, 6 and 4 are positioned such that they constitute the apices of an isosceles triangle, and that, together, they support the drum 2.

When considering FIG. 5.2, it will be seen that all the drums are supported by three shafts, and that the number of shafts corresponds to the number of drums.

Thus, each shaft serves both as a drive shaft for a drum and as an idling shaft for the other drums. This structure ensures a great saving of materials, and it is simultaneously possible to construct drive units with a large number of drums in a relatively small space.

FIGS. 6.1 and 6.2 show the structure of an expansion mandrel 21. FIG. 6.1 shows the mandrel when being introduced into a pipe, and FIG. 6.2 shows the mandrel when being pulled out.

The mandrel 21 consists of a solid centre member 25 which is configured with threads at both ends. The centre member has mounted thereon an expansion ball 22, which is arranged in the mandrel between an end nut 30 with a bowl-shaped engagement face 31 and a cylindrical member 28 with bearing bushes 34. The cylindrical member 28 engages the expansion ball with a spring pressure determined by a counterpressure spring 27. The counterpressure spring is locked at one end by the stop bushing 29.

The expansion ball 22 comprises at least three ball shell parts 23. In a preferred embodiment, the expansion ball comprises five ball shell parts, but the number may also be larger, e.g. up to nine ball shell parts.

The ball shell parts 23 surround a cone 24 of hardened steel, and the shell parts are kept in position by a helical spring 26.

The smallest diameter of the expansion ball occurs during the introduction of the mandrel, as shown in FIG. 6.1, where the friction against the sides of the pipe displaces the shell parts rearwardly toward the smallest diameter of the cone. The expansion ball is expanded when the mandrel is pulled out, as shown in FIG. 6.2, in that the pull moves the cone inwardly between the shell parts. The ball and thus the pipe are expanded hereby.

The extent of the expansion is determined by how many fitting discs 33 are arranged in the recess 32.

The invention claimed is:

1. A machine for the expansion of pipes, comprising:

a machine frame equipped with an expansion mandrel and at least one drive unit for pressing or pulling the expansion mandrel through a pipe;

the at least one drive unit including at least one motor-driven drum and at least one band or wire guide which extends from an outlet of the at least one motor-driven drum and forwardly to the pipe, said at least one motor-driven drum being adapted to press or pull a band or a wire with the expansion mandrel through the pipe, wherein the expansion mandrel is expandable, and wherein the at least one motor-driven drum comprises two lateral plates, a hub disposed between the two lateral plates and equipped with a band or a wire along an outer rim of the hub, and a circular guideway, said hub comprising a driving gearwheel and at least two idling gearwheels arranged internally in and in engagement with a toothed rim in the hub, and wherein the circular guideway of the drum is formed by bearings disposed in a circle between the lateral plates of the drum and along the outer rim of the hub.

2. A machine according to claim 1, wherein the at least one drive unit is equipped with a plurality of drums disposed side by side between the lateral plates, and wherein each of the plurality of drums is connected with a separate motor drive and a band or wire guide of its own.

3. A machine according to claim 1, wherein each motor drives a shaft which extends between the lateral plates of the drive unit, and which is in firm engagement with the driving gearwheel and in loose engagement with the idling gearwheels.

4. A machine according to claim 1, wherein a mutual distance between the drums with the at least one band or wire guide is adjustable.

5. A machine according to claim 1, wherein the machine is equipped with two drive units, said two drive units being configured mirror-inverted and being disposed side by side in an upright position on a carriage.

6. A machine according to claim 1, wherein the machine is equipped with more drive units, said drive units being configured mirror-inverted in pairs, with a first pair disposed in an upright position on the carriage and a second pair in a reversed position as well as additional pairs disposed in the same manner in a retracted position.

7. A machine according to claim 1, wherein the expansion mandrel comprises an expansion ball consisting of at least three shell parts which surround a centre cone, said cone being mounted on a centre member, and wherein the shell parts are additionally surrounded by a spring which keeps the shell parts in position.

8. A machine according to claim 7, wherein the expansion mandrel additionally comprises a counterpressure spring, a cylindrical member with a bearing bush, a stop bushing and an end nut.

9. A machine according to claim 7, wherein the end nut is configured with a rounded side and with an oppositely directed engagement face, which is configured as a bearing bush adapted to the shape of the shell parts, and which is equipped with a recess to receive one or more fitting discs.

10. The machine of claim 1, wherein the machine is for the expansion of pipes for heat exchangers.

11. A machine according to claim 1, wherein the band or wire guide extends horizontally from the outlet of the at least one motor-driven drum.

* * * * *